US007552593B2

(12) United States Patent
Smith

(10) Patent No.: US 7,552,593 B2
(45) Date of Patent: Jun. 30, 2009

(54) SUPPLYING DRAUGHT BEVERAGES

(75) Inventor: Stephen Paul Smith, Ashbourne (GB)

(73) Assignee: Coors Brewing Company, Golden, CO (US)

( * ) Notice: Subject to any disclaimer, the term of this patent is extended or adjusted under 35 U.S.C. 154(b) by 159 days.

(21) Appl. No.: 10/514,677

(22) PCT Filed: May 23, 2003

(86) PCT No.: PCT/GB03/02241

§ 371 (c)(1),
(2), (4) Date: Jul. 7, 2005

(87) PCT Pub. No.: WO03/099703

PCT Pub. Date: Dec. 4, 2003

(65) Prior Publication Data

US 2005/0249852 A1 Nov. 10, 2005

(30) Foreign Application Priority Data

May 25, 2002 (GB) ..... 0212085.5

(51) Int. Cl.
*B67D 5/62* (2006.01)

(52) U.S. Cl. ..... 62/59; 62/389

(58) Field of Classification Search ..... 62/3.64, 62/59, 434, 435, 389–390; 222/146.6
See application file for complete search history.

(56) References Cited

U.S. PATENT DOCUMENTS 4,730,463 A * 3/1988 Stanfill ..... 62/399
4,829,771 A * 5/1989 Koslow et al. ..... 62/3.64
5,537,825 A * 7/1996 Ward ..... 62/3.64
6,324,850 B1 12/2001 Davis
6,442,960 B1 9/2002 Fournier et al.
6,490,870 B1 * 12/2002 Efremkine ..... 62/3.64
6,546,737 B1 * 4/2003 Heyes et al. ..... 62/3.64
6,694,748 B2 * 2/2004 Sergio et al. ..... 62/3.64
6,763,672 B1 * 7/2004 Anderson et al. ..... 62/289
6,925,816 B2 * 8/2005 Anderson et al. ..... 62/74
6,976,364 B1 * 12/2005 Bengtsson ..... 62/3.7

FOREIGN PATENT DOCUMENTS

| | | |
|---|---|---|
| EP | 0 683 224 | 11/1995 |
| EP | 0 866 028 | 9/1998 |
| EP | 0 999 177 | 5/2000 |
| EP | 1 084 989 | 3/2001 |
| EP | 1 148 023 | 10/2001 |
| EP | 1 188 996 | 3/2002 |
| FR | 2 785 601 | 10/1999 |
| GB | 2 368 897 A | 5/2002 |
| GB | 2 383 322 A | 6/2003 |
| WO | WO 99/60092 | 11/1999 |
| WO | WO 01/36582 | 5/2001 |

* cited by examiner

*Primary Examiner*—William E Tapolcai
(74) *Attorney, Agent, or Firm*—Sheridan Ross P.C.

(57) ABSTRACT

Draft beverage is cooled in a cooling water tank in a cooling unit under a drinks bar. It is then cooled in a thermoelectric cooler, and transferred to a font in pipe which is surrounded in a water jacket of cooling water from the tank. The water jacket is connected to a further water jacket for a tube of cooling water which is also supplied to the font for cooling a glass into which the beverage will be dispensed. The waterjacket keeps the beverage in the pipe cool, but above freezing point, when it is static prior to dispense.

1 Claim, 2 Drawing Sheets

SUPPLYING DRAUGHT BEVERAGES

Figure 1:
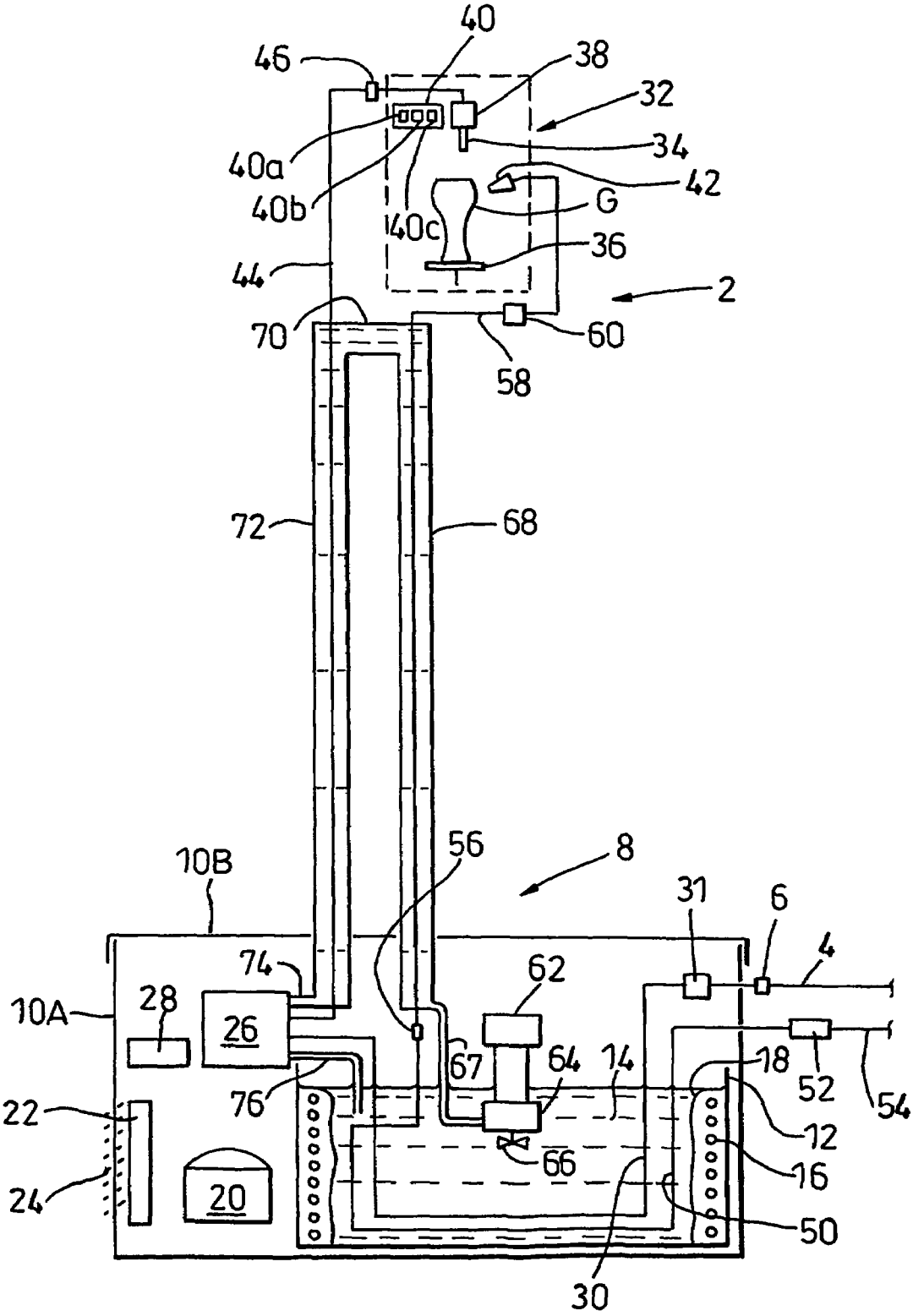

This invention relates to supplying draught beverages, and, more particularly to a method of supplying cooled draught beverage and apparatus for supplying cooled draught beverage.

It is known, for example from International Publication No. WO99/60092 (International Application No. PCT/GB99/01551) to supply cooled draught beverage to a vessel.

An aim of the invention is to provide a method of supplying draught beverage which may be performed by using an apparatus to supply draught beverage wherein the overall size of a cooling module of the apparatus can be of smaller size than would normally hitherto be required so that the overall size of the cooling module can be reduced; said cooling module, for example receiving draught beverage from a supply, for example through a python, and the module cooling or further cooling the received beverage and then supplying it, for example, on demand, to an outlet, for example a beverage nozzle, which may be included in a font which may be mounted, for example, on a counter of a drinks' bar. It is known to mount cooling modules in the vicinity of a bar, thus the smaller the module (and the less its heat output into the bar environment) the better.

Another aim is to provide an apparatus to supply draught beverage, wherein said apparatus has comparatively few moving parts.

A further aim is to provide an apparatus to supply draught beverage, wherein although the beverage is cooled prior to delivery from a beverage nozzle into a vessel (for example a drinking vessel), the need to keep the prior cooled beverage circulating when no delivery from the nozzle is being demanded is avoided and thus the apparatus need have no circulation loop; also in a case where the nozzle is included in a font, the font need not comprise or include a heat exchanger to apply final cooling to the beverage just before it emerges from the nozzle.

A yet further aim is to provide a method of dispensing a beverage having a dissolved gas content (one example being beer, for example lager) wherein fobbing is reduced.

According to an aspect of the invention a method of supplying cooled draught beverage comprises supercooling the beverage at a cooling means, conveying the beverage from the cooling means to an outlet for dispensing through a passage means in which some of the beverage has been static prior to being dispensed.

Preferably the supercooling is carried out using a thermoelectric effect.

The method may comprise cooling the beverage using a volume of liquid coolant.

In a case where the beverage has a dissolved gas content, said supercooling can reduce fobbing of the dispensed beverage in the vessel.

The beverage may be supercooled to at least substantially 1.5° C. below its freezing point at the ambient atmospheric pressure, for example to at least substantially 2.0° C. below said freezing point. The beverage may be supercooled to a temperature in a range of substantially 1.5° C. to 2.5° C. below the freezing point of the beverage at the ambient atmospheric pressure, for example, in a range of substantially 2.0° C. to 2.5° C. below said freezing point. The beverage issuing from the outlet may enter the vessel in a supercooled state.

The extraction of heat from the beverage using the Peltier effect may be a heat removal step taking the beverage into the supercooled state. In the case where the beverage has a water content and a dissolved gas content cooling the beverage being dispensed to below 0° C. can reduce fobbing.

The beverage may be cooled to a temperature below −3.0° C. For example, the beverage may be cooled to a temperature of at least substantially −4.0° C., or to a temperature below substantially −4.0° C., or to a temperature of substantially −4.5° C., or to a temperature in a range of substantially −3.5° C. to substantially −4.5° C., for example a range of substantially −4.0° C. to substantially −4.5° C.

The present invention provides a method of supplying cooled draught beverage to a vessel comprising moving draught beverage along a conduit arrangement to an outlet from which the beverage can be dispensed, and cooling the draught beverage in the course of its travel along the conduit arrangement, said cooling comprising using a volume of liquid coolant to extract heat from the beverage and using a thermoelectric effect to extract heat from the beverage.

The beverage may be cooled by the coolant.

Said coolant may be water.

The draught beverage may be cooled by said volume of liquid coolant prior to experiencing cooling by the thermoelectric effect.

Subsequent or prior to experiencing cooling by the thermoelectric effect the cooled draught beverage may be exposed, between the outlet and a thermoelectric cooling region wherein the thermoelectric effect occurs, to thermal contact with said liquid coolant.

Said liquid coolant may be in a liquid coolant beverage jacket, through which the beverage is passed, when it experiences said thermal contact. The liquid coolant may be circulated between said beverage jacket and said volume of liquid coolant.

Heat extracted from the beverage by said thermoelectric effect may be removed by said liquid coolant, for example after the liquid coolant has been in said thermal contact with the beverage.

Preferably the beverage is cooled by the thermoelectric effect at a thermoelectric cooling region, and the beverage is conveyed from the thermoelectric cooling region to the outlet through passage means in which some of the beverage has been static prior to being dispensed.

More preferably the beverage is dispensed in at least one predetermined volume and the volume of the beverage which has been static in said passage means is significantly less than said at least one predetermined volume.

A chilling liquid may be cooled by the liquid coolant and applied to the exterior of a vessel into which the beverage is dispensed.

Preferably the chilling liquid is cooled by passage through the volume of coolant. The chilling liquid may also be brought into thermal contact with the liquid coolant while the coolant is in a coolant conduit, for example, by means of a chilling liquid jacket, which may be the beverage jacket.

Alternatively it may be separate, in which case the chilling liquid jacket is preferably in fluid communication with the beverage jacket.

Preferably the same cooling conduit is in thermal contact with the chilling liquid and the beverage.

Preferably the cooling conduits are in fluid communication with each other

Conveniently liquid coolant may be circulated from said volume of liquid coolant through the or each coolant conduit, for example, the or each said jacket, for example the liquid coolant from said volume may pass through the chilling liquid jacket before passing through the beverage jacket.

Preferably liquid coolant from said volume of liquid coolant is circulated for removal of heat extracted from the beverage by the thermoelectric effect, preferably after passing through said jacket or jackets.

The temperature of the beverage cooled by the thermoelectric effect may be measured, and the dispense of the beverage is inhibited until the measured temperature is reduced to at least a predetermined value.

Said pre-determined value may be in the range of substantially −4.0° C. to substantially −4.5° C.

The beverage may be alcoholic or non-alcoholic. For example it may have an alcoholic strength of substantially 5% alcohol by volume.

Preferably, before experiencing the thermoelectric effect, the draught beverage is cooled by the liquid coolant to a temperature in a range of substantially 1.5° C. to substantially 0.5° C.

The draught beverage may be cooled to a temperature in a range of substantially −4.0° C. to substantially −4.5° C. by the thermoelectric effect.

The beverage may be delivered to said volume at a temperature in the range of substantially 6.0° C. to substantially 8° C.

The liquid coolant in said volume may be at a temperature of substantially 0° C. The liquid coolant supplied to a said jacket may also be at a temperature of substantially 0° C.

The thermoelectric effect may be the Peltier effect.

Preferably the volume of cooling liquid is contained in a tank.

The present invention further provides apparatus for supplying cooled beverage to a vessel, the apparatus comprising cooling means for cooling the beverage and passage means for conveying the beverage from the cooling means to an outlet, wherein the apparatus is arranged to dispense the beverage in at least one predetermined volume, and the passage means has a volumetric capacity which is substantially less than said at least one predetermined volume.

The present invention further provides apparatus for supplying cooled draught beverage to a vessel, the apparatus comprising a coolant tank, thermoelectric cooling means and an outlet from which beverage can be dispensed, a first conduit extending from the coolant tank and being arranged to supply beverage to the cooling means; and a second conduit arranged to transfer beverage from the cooling means to the outlet.

The apparatus may include a compact unit comprising said tank and said thermoelectric means, which compact unit may further comprise refrigeration means for cooling coolant for the tank and/or at least a part of a control system for controlling operation of the apparatus.

The compact unit may, for example, be mountable under a counter top of a drinks bar, and may conveniently be disposed within a real or imaginary envelope of a substantially parallelepiped shape, preferably having a volume of less than 0.5 $m^3$ and also preferably having a weight of less than substantially 50 kg.

The outlet may comprise a nozzle mounted on a font, and the font may be mountable on a drinks bar.

The second conduit may form at least part of a passage means for conveying the draught beverage substantially directly from the thermoelectric cooling means substantially directly to said outlet.

Preferably the apparatus is arranged to dispense the beverage in at least one predetermined volume, and the passage means has a volumetric capacity which is substantially less than said at least one predetermined volume.

The passage means preferably has a capacity of less than substantially 30 ml, more preferably less than 20 ml, and still more preferably less than substantially 15 ml. It also preferably has a length of less than 5 m, more preferably less than substantially 3 m.

The apparatus preferably includes coolant carrying means arranged to carry the liquid coolant such that it extracts heat from said thermoelectric means and is returned to the tank.

Preferably at least part of the second conduit is arranged to be in thermal contact with the liquid coolant from the tank.

Preferably said part of the second section is surrounded by a liquid coolant jacket which forms a beverage jacket.

Preferably the first or second conduit comprises the first conduit.

The apparatus may further comprise a nozzle arranged for directing at least one jet of chilled cooling water onto a said vessel. In this case the apparatus preferably also includes a cooling water conduit for conveying the cooling water, the conduit extending, at least in part, in thermal contact with the liquid coolant to cool said cooling water.

At least part of the cooling water conduit is preferably surrounded by a jacket of the liquid coolant forming a cooling water jacket, in which the liquid coolant may be arranged to flow.

Preferably liquid coolant can flow from the tank into the cooling water jacket and therefrom into the beverage jacket.

Preferably liquid coolant can flow in the thermoelectric cooling means to carry heat away therefrom and return to the tank.

The apparatus may further comprise cooling water leak detection means to detect an undesired flow of said cooling water along the cooling water conduit. It may also further comprise valve means to stop supply of cooling water along said cooling water conduit in the event of detection of said undesired flow.

The liquid coolant may be water.

The apparatus may further comprise ultra-sound emitting means to subject beverage dispensed by the apparatus to ultra-sound signals.

The apparatus may further comprise means to rotate said vessel.

Figures 2, 2A:
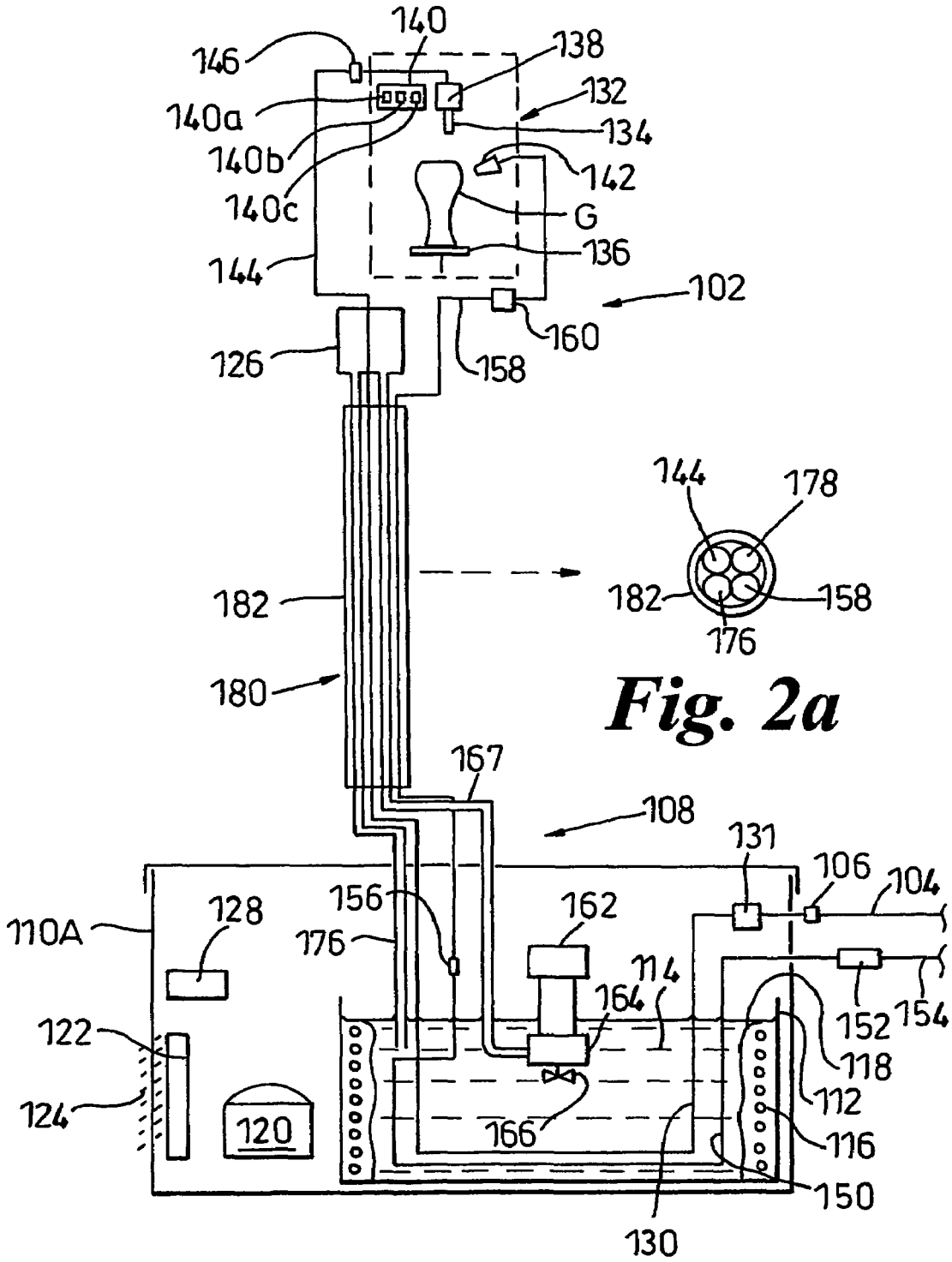

The invention will now be further described, by way of example, with reference to the accompanying drawings in which FIG. 1 is a diagram of an apparatus to supply cooled draught beverage according to the a first embodiment of the invention, FIG. 2 is a diagram of an apparatus according to a second embodiment of the invention; and FIG. 2*a* shows a section through a conduit forming part of the apparatus of FIG. 2.

Referring to FIG. 1, apparatus to supply and dispense cooled draught beverage is indicated at 2. The draught beverage may be non-alcoholic or alcoholic and may have a water content and/or a dissolved gas content, which dissolved gas content may be or comprise carbon dioxide or nitrogen or comprise a mixture thereof.

Suitable draught alcoholic beverages may be, for example, cider or a flavoured alcoholic beverage or beer. The beer may be lager, ale, stout or porter.

The draught beverage may be stored in a bulk state, for example in a cask or tank, under relatively cool conditions, for example at substantially 11° C. to substantially 13° C., in, for example, a cellar and may be propelled from store, by for example gas pressure and/or pump means, along a pipe or product line 4 to a coupling 6 to a beverage cooling unit or module 8 having an outer casing comprising a casing body 10A and a casing cover 10B. The product line 4 may form part of a known python for cooling the beverage in the product line such that the beverage arriving at the cooling module may be at a temperature in a range of substantially 6° C. to substantially 12° C.

Within the casing 10A, 10B are:

(i) a liquid coolant tank 12 containing liquid coolant 14, preferably water, (ii) a refrigerating or cooling coil 16 (within an ice mantle 18) to cool the water 14 and being part of a refrigerating system further comprising a compressor and expansion valve unit 20 and a condensor/heat exchanger 22 to emit heat adjacent to vent 24 in the casing, (iii) a thermoelectric cooler 26 using the Peltier effect to produce cooling, and (iv) a controller 28 including electrical and electronic constituents of an electrical control system of the apparatus 2.

A beverage cooling tube 30, which may be in the form of a coil or loop, is for at least part of its length immersed in the water 14 and is connected at one end to the product line 4 through connector 6 and at its other end to a beverage passage through the thermoelectric cooler 26. Included in beverage tube 30 is metering means 31, for example a metering turbine, used in the making of a volumetric measure of beverage being dispensed by the apparatus and sending signals representative of the measurement to the controller system.

A font indicated at 32 is provided and may be mounted in or adjacent to a drinks' bar, for example on a bar counter, to dispense beverage which issues, when desired when the apparatus is in use, from a nozzle 34 into a vessel G, which can be a drinking vessel, for example a glass, removably standing on a platform 36 with which the font is also provided; said platform being rotatable by motor means (not shown) to rotate the glass during beverage dispense. The font 32 also includes a control valve 38 which is opened to allow beverage to issue from the nozzle 34 and closeable to stop dispense of beverage, a control key-pad 40, and a nozzle 42 to direct a spray or one or more jets of chilled cooling water onto an exterior of glass G at some desired time during a beverage dispense procedure. The font 32 may also comprise means to emit ultra sound at a desired time under control of the control system.

A flexible line or tube 44 extends from a beverage outlet from the thermoelectric cooler 26 to a connector 46, at or adjacent to the font 32 to supply beverage to the control valve 38.

A water cooling tube 50, which may be in the form of a coil or loop, is for at least part of its length immersed in the water 14 and is connected at one end to a normally open cut-off valve 52 connected to a supply 54 of water at mains pressure. At its other end the water cooling tube 50 is connected at 56 to a flexible water line or tube 58 supplying nozzle 42 with chilled water to spray on the outside of a glass G to cool the latter as the water streams over the glass's exterior. A normally closed chill valve 60 is included in tube 58 and is connected to the control system which opens the chill valve 60 when a chilled water spray is required. A water flow detector (not shown) is provided to observe water flow from the water supply 54 when the chill valve 60 is closed or the control system thinks that the valve is closed. Under those circumstances such water flow is a fault and undesired, and may result in flooding. Thus when said flow detector signals the control system that water flow is being observed, the control system operates to cause the valve 52 to close and stop any water flow into the tube 58 from the supply 54.

Tank 12 is provided with motor 62 continuously driving (i) a water pump 64 and (ii) a stirrer comprising a rotating paddle 66 to continuously stir the water 14 in the tank whilst the pump continuously pumps cold water from the tank along pipe 67 into an end of a tube-in-tube cooler or tubular water jacket 68 surrounding a greater part of the length of the cooling water tube 58 and bringing the water from the tank into thermal contact with the cooling water for chilling the glass. At its other end the water jacket 68 has a conduit 70 supplying the cold water output into an end of another tube-in-tube cooler or water jacket 72 surrounding a greater part of the beverage tube 44, and bringing the water from the tank into thermal contact with the beverage. Cold water output from the other end of the water jacket 72 is supplied along pipe 74 into the thermoelectric cooler 26 to flow therethrough and act as coolant carrying away heat from an arrangement of hot Peltier junctions; the water discharging from the cooler 26 through outlet pipe 76 into the tank 12.

The water 14 in tank 12 is cooled to a suitable desired temperature, for example substantially 0° C., and it is substantially at that temperature that it passes in succession through the jacket 68 and jacket 72 to the thermoelectric cooler 26.

The control keypad 40, which comprises three push-buttons, is connected to the controller 28. Pressing one push button 40*a* causes apparatus 2 to operate and open and close the control valve 38 as appropriate and automatically deliver substantially a first pre-determined measured volume of beverage, for example one pint (0.571) from nozzle 34, pressing another of the push buttons 40*b* causes the apparatus automatically to deliver another different second pre-determined measured volume, for example one half-pint (0.281) from the nozzle 34, whilst pressing and releasing the third push button 40*c* operates the controller 28 to open and close the dispense valve 38 in time with depression or release of the button to supply squirts of topping up beverage.

When dispense of a desired predetermined volume of beverage is desired, a glass G is placed on the platform 36 and the appropriate button on keypad 40 pressed. This causes the controller 28 to operate so that the apparatus automatically goes through a beverage dispense cycle. In this the platform 36 is started to rotate and does so continuously until the cycle ends, and the valve 60 is opened for a desired predetermined time, for example five seconds or longer, so that the chilling water spray is directed onto the outside of the glass G for that time to cool the glass, the chilling water issuing from the nozzle 42 may be at temperatures of substantially 2° C. Then the control system causes the dispense valve 38 to open to deliver automatically a desired predetermined volume of the beverage into the glass G. The thermoelectric cooler 26 can be arranged to cool the beverage such that the beverage is supercooled, for example to a temperature below 0° C. and supercooled beverage may issue into the glass G. The beverage, which issues from the nozzle 34 may be supercooled to a temperature at least substantially 1.5° C. below the freezing point of the beverage at ambient atmospheric pressure, for example to at least substantially 2.0° C. below said freezing point. The beverage may be supercooled to a temperature in a range of substantially 1.5° C. to 2.5° C. below the freezing point of the beverage at the ambient atmospheric pressure, for example in a range of substantially 2.0° C. to 2.5° C. below said freezing point. The thermoelectric cooler 26 can be arranged to cool the beverage to a temperature (at which temperature the beverage may issue into the glass G) to below −3.0° C., for example in a range of substantially −3.5° C. to −4.5° C. or more particularly in a range of substantially −4.0° C. to −4.5° C.

The controller 28 may be arranged so that beverage is not delivered from the nozzle 34 (i.e. the nozzle is held closed) until a temperature sensor in the thermoelectric cooler 26 senses that a temperature therein is lowered to a desired predetermined value (or is lowered to lie within a predetermined temperature range) sufficient to ensure that liquid beverage is output from the thermoelectric cooler in a desired supercooled state.

The amount of beverage dispensed into the glass G is measured by the beverage metering means 31 which sends volume measurement data to the control system. When a predetermined fraction of the total desired volume of beverage being served in the glass G has been dispensed, for example substantially 99% and measured by metering means 31 the beverage dispense cycle continues for the final fraction of the desired measured amount, for example the final 1% of beverage, to be delivered into glass G and during this final delivery the control system causes the flow of beverage to be exposed automatically to an ultrasound signal for a desired predetermined time period. The beverage metering means 31 indicates to the controller 28 when the full desired predetermined amount of beverage has been dispensed (say one pint or 0.671) and the controller 28 operates to close the dispense valve 38 thereby stopping delivery to the glass. When the controller 28 recognises that the desired amount of beverage has been dispensed, the it causes the chill valve 60 to open for a predetermined time, which may be relatively short, whereby chilled water as before is sprayed from the nozzle 42 onto the exterior of the glass G.

When the water spray is over, the control system causes platform 36 to stop rotating and the glass of beverage may be lifted away from the font 32.

The glass chilling water which may be emitted from the nozzle 42 at a temperature of substantially 2° C. may leave the tank 12 at a temperature of substantially 0.5° C.

There may be some heat transfer through the walls of the tubes 44 and 58 even though each may be of material normally thought of as insulating, for example a plastic material. The beverage tube 44 may be of relatively short length between the thermocooler 26 and the font 32, for example approximately 2.5 m in length and may have a relatively small (very small) internal volume, for example substantially 15 ml, and may therefore have an internal cross sectional area of about 6 $mm^2$.

When the apparatus 2 is not delivering beverage to the nozzle 34, the liquid beverage may stand in the tube 44 ready for dispense. In this static state the beverage temperature will generally rise so as to be higher than the desired dispense temperature, since, although the beverage is being kept cool by the water continuously passing through the jacket 72 at about 0° C. this is higher than the supercooled dispense temperature, and also just higher than the freezing point of the beverage, which in this case is about −2° C. Warming the static supercooled beverage to this temperature therefore helps to ensure that beverage which is static in the tube 44 does not freeze. But the volume of beverage standing in the tube 44 is so small (in comparison to a desired measured delivered volume) that when the control system is satisfied that the thermoelectric cooler 26 is operating so that it will give a beverage output at the desired supercooled temperature, the apparatus starts to dispense beverage and the small volume of higher temperature beverage is overwhelmed in glass G by the much larger volume at the desired lower temperature so the total measured volume is at substantially the desired lower temperature.

A beverage may arrive at the water tank 14, through the python at the beverage temperature of substantially 6° C. to 12° C., and the beverage may emerge from the tank and enter the thermocooler 26 at a beverage temperature of substantially 0.5° C. to 1.5° C. The thermoelectric cooler 26 may operate such that beverage emerges from the cooler 26 at a beverage temperature of substantially −4.0° C. to −4.5° C. for supply to the font 32; the thermoelectric cooler 26 when operating may have Peltier effect cold junctions at a temperature in a desired range of substantially −4.0° C. to −7.0° C. and this range being observable by the aforesaid thermostat means. Such a beverage may be a beer, for example a lager, which may have a strength of substantially 5% a.b.v. The cooler 26 may only operate when a signal from the keypad 40 indicates that beverage dispense is being required, otherwise, when beverage dispense is not required, timing means in the control system may shut off the thermoelectric cooler.

The aforedescribed unit or module 8 is compact and relatively light in weight. For example the casing 10A, 10B may be of parallelepiped shape substantially 790 mm long (or wide)×substantially 470 mm deep×substantially 355 mm high. The weight of the module including the casing 10A, 10B (and including or not including the coolant 14) may be less than 50 kg, for example substantially 45 kg. Such a module may be mountable on a shelf, for example in a drinks' bar area, and/or under a bar counter. A further advantage is that the module 8 has few moving parts, and no beverage cooling heat exchanger or cooler is required at or adjacent to the font 32. Also, since the beverage in the tube 44 is static when beverage dispense is not required, pumps and other controls which would normally be used in beverage circulation are not needed, and if the beverage is a beer, for example a lager, beer quality may be improved by the avoidance of circulation. Furthermore, complex electronic controls are now mainly to be found in the control box 28 in the module 8 and not in the font 32.

FIG. 2 shows a second embodiment of the invention. This embodiment is similar to the first in some aspects, and corresponding components are indicated by the same reference numeral increased by 100. The main difference in the second embodiment is in the position of the thermoelectric cooler 126 and the method of transfer of beverage and cooling liquid to the font 132.

The thermoelectric cooler 126 is positioned adjacent to the font 126 and remote from the coolant tank 112 which is placed under the bar counter as in the previous embodiment. The beverage tube 130, after passing through the coolant tank 112, leads to the thermoelectric cooler 126 via a python 180 which is shown in section in FIG. 2*a* and is made up of a number of parallel tubes housed in an insulating covering 182. The coolant feed pipe 167 from the tank 112 to the thermoelectric cooler 126, and the coolant return pipe 176 from the thermoelectric cooler 126 back to the tank 112 form two further pipes in the python 180. The cooling water feed tube 158 makes up the fourth tube in the python 180. The python 180 therefore extends over a substantial part of the distance from the tank 112 to the font 132. The beverage tube 144 from the thermoelectric cooler 126 to the nozzle 134 is relatively short, which has the advantage that the volume of beverage which remains static in the feed tube between subsequent dispense cycles is relatively small. In this region of the beverage tube 144 the supercooled static beverage is warmed to a temperature above its freezing point by virtue of being in thermal contact with air at ambient temperature. The python 180 can therefore be longer than the jacketed tube sections in the first embodiment without significantly affecting beverage quality and temperature. In this embodiment the python is 5 m long. Because the tubes 144, 158, 167, 176 in the python are in thermal contact with each other and thermally insulated by the covering 182 the beverage and the cooling water in the python are kept cool by the liquid coolant 114. As in the first embodiment the liquid coolant also removes heat from the thermoelectric cooler 126 and returns it to the coolant tank.

It will be appreciated that the python conduit of the second embodiment could be used in place of the cooling jacket conduit arrangement of the first embodiment, and vice versa.

The invention claimed is:

1. A method of dispensing a dispensed volume of cooled beverage into a drinking vessel comprising:

(i) cooling beverage in a cooling region of a beverage supply line leading to a dispense tap from which said beverage is dispensed, said cooling region of said supply line having a relatively small volume in comparison with said dispensed volume;

(ii) reducing the cooling of beverage provided at said cooling region during a non-dispense period of operation of said tap, thereby allowing beverage held in said cooling region of said beverage supply line to warm up under the influence of ambient temperature after said first dispense operation has ended, said warmed up beverage comprising retained beverage in said cooling region;

(iii) dispensing in a second dispense operation another dispensed volume of said beverage into a said drinking vessel via said dispense tap; increasing cooling of said beverage provided by said dispense region in said second dispense operation in comparison with cooling provided by said cooling region during said non-dispense period, said dispensed volume of dispensed into said drinking vessel comprising said retained beverage and also additional beverage which has passed through said cooling region during said second dispense operation and has been cooled in said cooling region, said additional beverage being dispensed at a cooler temperature than that at which said retained volume is dispensed, and the volumes of said retained volume and said additional volume being such that said dispensed volume of beverage dispensed in said second dispense operation has a temperature that is substantially unaffected by the temperature difference between said retained volume when it is dispensed and said additional volume when it is dispensed.

* * * * *